US010551021B2

(12) United States Patent
Yan et al.

(10) Patent No.: US 10,551,021 B2
(45) Date of Patent: Feb. 4, 2020

(54) VEHICLE LAMP ILLUMINATING APPARATUS WITH ABILITY FOR IMPLEMENTING VARIOUS ILLUMINATING LIGHT PATTERNS

(71) Applicant: HASCO VISION TECHNOLOGY CO., LTD., Shanghai (CN)

(72) Inventors: Meng Yan, Shanghai (CN); Juejing Yang, Shanghai (CN)

(73) Assignee: SHANGHAI KOITO AUTOMOTIVE LAMP CO., LTD., Jia Ding, Shanghai (CN)

( * ) Notice: Subject to any disclaimer, the term of this patent is extended or adjusted under 35 U.S.C. 154(b) by 0 days.

(21) Appl. No.: 16/108,359

(22) Filed: Aug. 22, 2018

(65) Prior Publication Data

US 2019/0195458 A1 Jun. 27, 2019

(30) Foreign Application Priority Data

Aug. 24, 2017 (CN) ..... 2017 1 07371063
Aug. 24, 2017 (CN) ..... 2017 2 10679535 U

(51) Int. Cl.

| | |
|---|---|
| ***F21S 41/663*** | (2018.01) |
| ***F21S 41/143*** | (2018.01) |
| ***F21S 41/151*** | (2018.01) |
| ***F21S 41/365*** | (2018.01) |
| ***F21S 41/20*** | (2018.01) |

(52) U.S. Cl.
CPC ..... *F21S 41/663* (2018.01); *F21S 41/143* (2018.01); *F21S 41/151* (2018.01); *F21S 41/28* (2018.01); *F21S 41/365* (2018.01)

(58) Field of Classification Search
CPC ..... F21S 41/663; F21S 41/151; F21S 41/365; F21S 41/143; F21S 41/28
See application file for complete search history.

(56) References Cited

U.S. PATENT DOCUMENTS

2019/0107265 A1* 4/2019 Yan ..... F21S 41/663

* cited by examiner

*Primary Examiner* — Joseph L Williams
(74) *Attorney, Agent, or Firm* — Global IP Services; Tianhua Gu

(57) ABSTRACT

A vehicle lamp illuminating apparatus with ability for implementing various illuminating light patterns is constructed by a lens, a circuit board, a plurality of light emitting diode (LED) light sources disposed on the circuit board and distributed in an array, and a reflection structure disposed between the plurality of LED light sources and the lens. The LED light sources are transversely arranged in an upper row and a lower row. The reflection structure has a plurality of reflection mirror sets each disposed in one-to-one correspondence with two LED light sources that are vertically opposite to each other. Luminance of one or more local areas of an illuminating light pattern can be adjusted, thus implementing various illuminating light patterns and meeting a self-adaptive requirement of a headlamp.

9 Claims, 2 Drawing Sheets

VEHICLE LAMP ILLUMINATING APPARATUS WITH ABILITY FOR IMPLEMENTING VARIOUS ILLUMINATING LIGHT PATTERNS

BACKGROUND OF THE PRESENT INVENTION

Field of Invention

The present invention relates to the technical field of vehicle lamps, and in particular, to a vehicle lamp illuminating apparatus, a vehicle lamp assembly comprising the vehicle lamp illuminating apparatus, and a vehicle comprising the vehicle lamp assembly.

Description of Related Arts

With the development of Light Emitting Diode (LED) technologies, LED has been widely applied to various fields. LED is also applied to an external illumination aspect of vehicles more commonly due to advantages such as low heat generation, long service life, environmental protection, quick response speed, being easily designed due to small volume, and the like.

A matrix LED self-adaptive headlamp can be used to adjust road illumination according to the situation of other traffic participants. For example, when the matrix LED self-adaptive headlamp is applied to high beam illumination, by intelligently adjusting a light pattern, danger caused by dazzle to a driver coming from an opposite direction is avoided. In addition, desirable illumination in other areas than the area in which the coming vehicle is located is ensured. The present invention aims to provide a vehicle lamp illuminating apparatus that can adjust luminance of a local area of an illuminating light pattern by controlling a light source, so as to meet a self-adaptive requirement of the headlamp.

SUMMARY OF THE PRESENT INVENTION

A technical problem to be resolved in the present invention is to provide a vehicle lamp illuminating apparatus, a vehicle lamp assembly comprising the vehicle lamp illuminating apparatus, and a vehicle comprising the vehicle lamp assembly that can adjust luminance of a local area of an illuminating light pattern and implement various illuminating light patterns, so as to overcome the foregoing defects in the prior art.

To resolve the foregoing technical problem, the present invention uses the following technical solutions:

A vehicle lamp illuminating apparatus comprises a lens, a circuit board, a plurality of LED light sources disposed on the circuit board and distributed in an array, and a reflection structure disposed between the plurality of LED light sources and the lens, where the plurality of LED light sources distributed in an array are transversely arranged in an upper row and a lower row, the reflection structure comprises a plurality of reflection mirror sets each disposed in one-to-one correspondence with two LED light sources that are vertically opposite to each other, the reflection mirror set comprises a first level reflection mirror located between the two LED light sources that are vertically opposite to each other, and a second level upper reflection mirror and a second level lower reflection mirror that are respectively disposed above and below the first level reflection mirror at an interval in an opposite manner; and light emitted by the LED light source in the upper row is incident into the lens after being reflected first by the first level reflection mirror and then by the second level upper reflection mirror, and light emitted by the LED light source in the lower row is incident into the lens after being reflected first by the first level reflection mirror and then by the second level lower reflection mirror.

Preferably, the second level upper reflection mirror and the second level lower reflection mirror are in an encircling form, and an opening direction faces the lens.

Preferably, the first level reflection mirror has a first level upper reflection surface corresponding to the LED light source in the upper row and a first level lower reflection surface corresponding to the LED light source in the lower row, and the first level upper reflection surface and the first level lower reflection surface form a cone whose contraction opening faces a position between the two LED light sources that are vertically opposite to each other.

Preferably, the first level reflection mirror has a first level upper reflection surface corresponding to the LED light source in the upper row and a first level lower reflection surface corresponding to the LED light source in the lower row, and the first level upper reflection surface and the first level lower reflection surface both have ellipsoidal surfaces, free-form surfaces, or planes.

Preferably, a first shielding member configured to prevent the light emitted by the LED light source in the upper row from being directly incident into the second level upper reflection mirror is disposed between the LED light source in the upper row and the second level upper reflection mirror; and a second shielding member configured to prevent light emitted by the LED light source in the lower row from being directly incident into the second level lower reflection mirror is disposed between the LED light source in the lower row and the second level lower reflection mirror.

Preferably, the LED light source is disposed on the circuit board, rotates around the transverse, wherein a maximum angle by which the LED light source transversely rotates does not exceed 45°.

Preferably, the lens is a balsaming lens.

A vehicle lamp assembly comprises the vehicle lamp illuminating apparatus described above.

A vehicle comprises the vehicle lamp assembly described above.

Compared with the prior art, the present invention has a notable progress:

The reflection structure is disposed between the LED light source array and the lens, so that the light emitted by the LED light sources can be incident into the lens after being reflected for two levels by the reflection structure. In addition, each LED light source located in the upper row and a first level reflection mirror and a second level upper reflection mirror corresponding to the LED light source in the upper row form a reflection unit. Each LED light source located in the lower row and a first level reflection mirror and a second level lower reflection mirror corresponding to the LED light source in the lower row also form a reflection unit. The LED light sources distributed in an array and the reflection mirror sets form a reflection unit array. Light emitted by a single reflection unit forms a flare after being transmitted by the lens. The flare may be used as a pixel spot of an integer illuminating light pattern formed after light emitted by the reflection unit array is transmitted by the lens, thus implementing pixelation of the illuminating light pattern. A flare formed after light emitted by each reflection unit is transmitted by the lens can be individually controlled by individually controlling turning on, turning off and luminance of each LED light source. Therefore, luminance of one or more local areas of an illuminating light pattern can be adjusted. In this way, various illuminating light patterns are implemented and a self-adaptive requirement of a headlamp is met. Especially, when a vehicle comes from an opposite direction, an LED light source of a reflection unit forming a flare in an area is turned off by determining the area corresponding to the coming vehicle in the illuminating light pattern. When necessary, luminance of an LED light source of a neighboring reflection unit may further be reduced. Therefore, the illuminating light pattern can be prevented from dazzling a driver of a coming vehicle, and desirable illumination in other areas than the area in which the coming vehicle is located is ensured, thereby ensuring driving safety.

1: Lens; 2: Reflection structure

Figure 1:
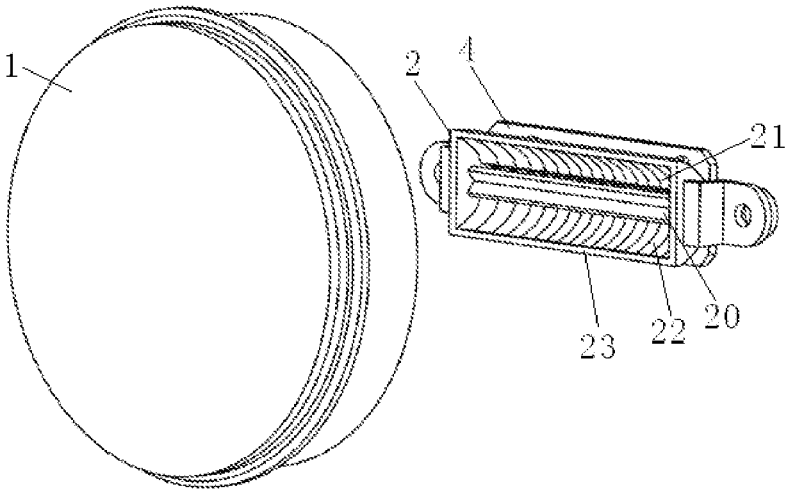
FIG. 1 is a schematic diagram of an overall structure of a vehicle lamp illuminating apparatus according to an embodiment of the present invention.

20: First level reflection mirror; 201: First level upper reflection surface

202: First level lower reflection surface; 21: Second level upper reflection mirror

211: Second level upper reflection surface; 22: Second level lower reflection mirror

221: Second level lower reflection surface; 23: Frame body

3: LED light source; 4: Circuit board

51: First shielding member; 52: Second shielding member

DETAILED DESCRIPTION OF THE PREFERRED EMBODIMENTS

Specific embodiments consistent with the present invention are further described in detail hereinafter with reference to the accompanying drawings. These embodiments are merely used for describing the present invention, instead of limiting the present invention.

In the description consistent with the present invention, it should be noted that, an orientation or position relationship indicated by a term such as "center", "longitudinally", "transversely", "above", "below", "front", "behind", "left", "right", "vertical", "horizontal", "top", "bottom", "internal", or "external" is an orientation or position relationship shown based on the accompanying drawings, and is merely for ease of description of the present invention and for simplifying the description, not for indicating or implying that an indicated apparatus or element needs to have a particular orientation and be constructed and operated in a particular orientation. Therefore, the orientation or position relationship shall not be construed as a limitation to the present invention. In addition, terms "first" and "second" are merely used for an objective of description and cannot be understood as indicating or implying relative importance. In the description consistent with the present invention, it should be noted that, unless otherwise specifically specified and defined, terms "installation", "linking", and "connection" should be generally understood. For example, connection may be a fixed connection, a detachable connection, or an integral connection; may be a mechanical connection, an electric connection, or by laser welding or other technologies; or may be a direct linking, an indirect linking by using an intermediate medium, or an internal communication between two elements. For those skilled in the art, specific meanings of the foregoing terms in the present invention may be understood based on a specific case.

In addition, in the description consistent with the present invention, unless otherwise described, "a plurality of" means two or more than two.

Figure 2:
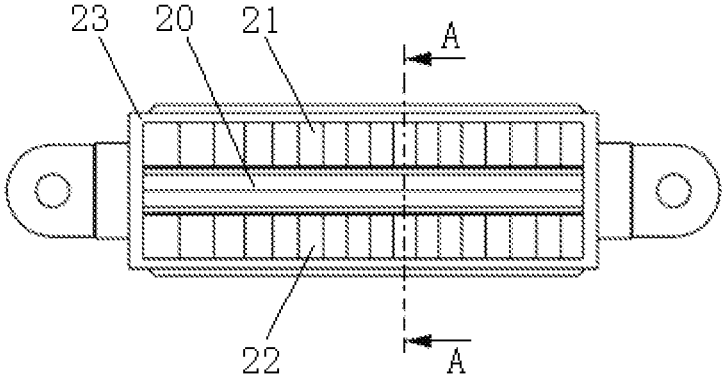
FIG. 2 is a schematic front view of a vehicle lamp illuminating apparatus whose lens is removed according to an embodiment of the present invention.
Figure 3:
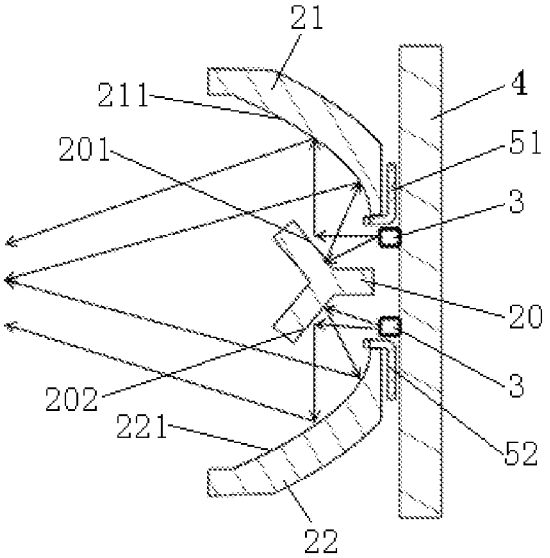
FIG. 3 is a schematic sectional view along A-A in FIG. 2 and a schematic diagram of light paths.
Figure 4:
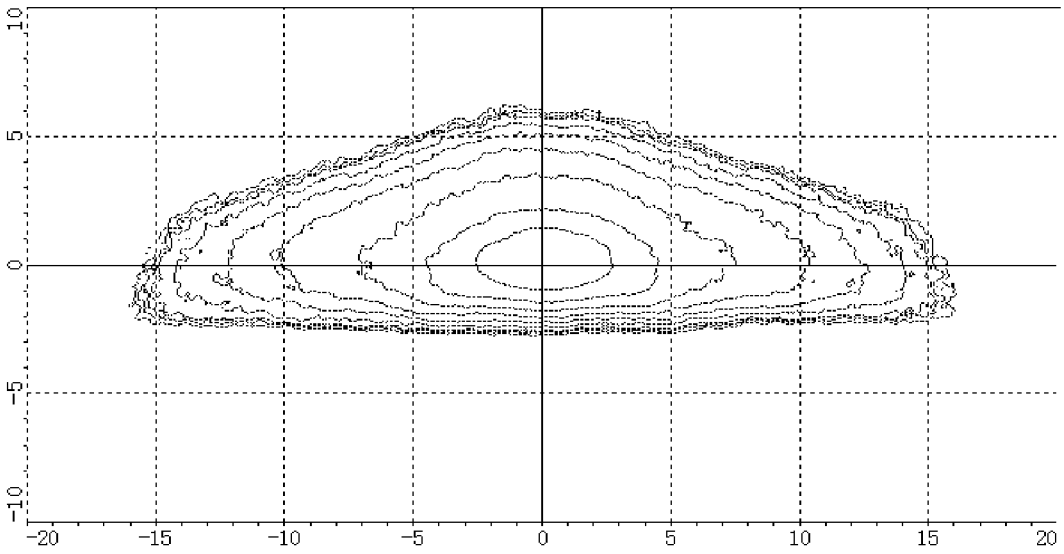
FIG. 4 is a schematic diagram of a complete high beam light pattern formed by a vehicle lamp illuminating apparatus according to an embodiment of the present invention.
Figure 5:
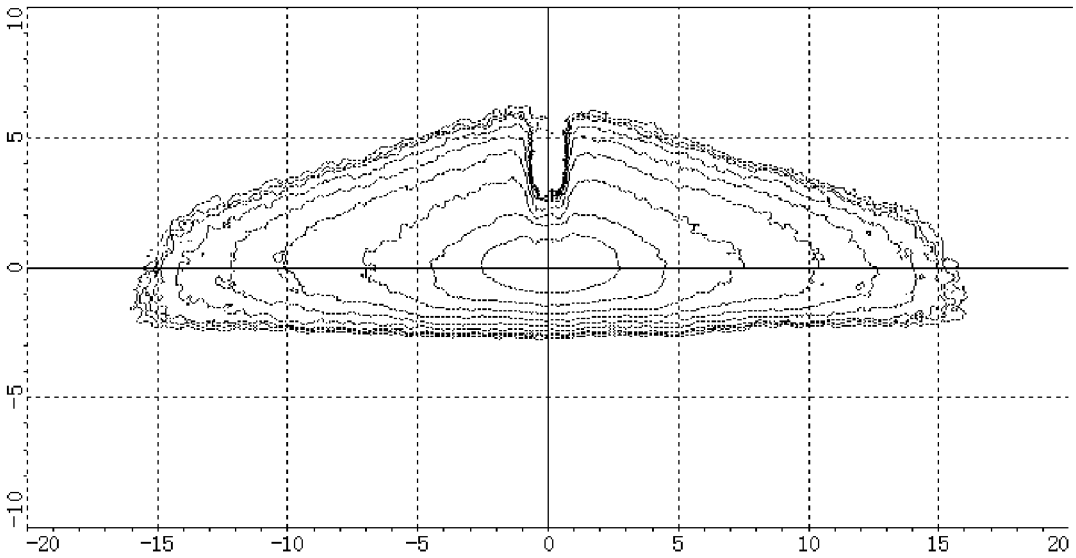
FIG. 5 is a schematic diagram of a high beam light pattern with a local loss formed by a vehicle lamp illuminating apparatus according to an embodiment of the present invention.

An embodiment of a vehicle lamp illuminating apparatus consistent with the present invention is shown in FIG. 1-FIG. 5. As shown in FIG. 1 to FIG. 3, the vehicle lamp illuminating apparatus of the present embodiment comprises a lens 1, a reflection structure 2, LED light sources 3, and a circuit board 4.

Wherein, there are a plurality of LED light sources 3, and all LED light sources 3 are distributed in an array to form an LED light source array. In the present embodiment, the LED light source array is transversely arranged in an upper row and a lower row, and is longitudinally arranged in several columns. All LED light sources 3 are disposed on the circuit board 4. The circuit board 4 is configured to carry the LED light sources 3 to control on and off of each LED light source 3 individually, and can freely adjust luminance of light emitted by each LED light source 3 individually in a range of 0 to 100%. Preferably, in the present embodiment, each LED light source 3 may be disposed on the circuit board 4, rotates around the transverse of the LED light source array individually, wherein a maximum angle by which each LED light source 3 transversely rotates does not exceed 45°. Thus, flexibility of adjusting an illuminating light pattern can be improved.

The reflection structure 2 is disposed between the LED light source array formed by the plurality of LED light sources 3 and the lens 1. The reflection structure 2 comprises a plurality of reflection mirror sets. All reflection mirror sets are arranged in a linear array, and each reflection mirror set is disposed in one-to-one correspondence with two LED light sources 3 that are vertically opposite to each other. A single reflection mirror set comprises a first level reflection mirror 20, a second level upper reflection mirror 21, and a second level lower reflection mirror 22. The first level reflection mirror 20 is located between two LED light sources 3 that are vertically opposite to each other, and is located at a side of the LED light source 3. The second level upper reflection mirror 21 and the second level lower reflection mirror 22 are respectively disposed above and below the first level reflection mirror 20 at an interval in an opposite manner. Light emitted by the LED light source 3 in the upper row (that is, the LED light source 3 that is located in the upper row in the LED light source array) is incident into the lens 1 after being reflected first by the first level reflection mirror 20 and then by the second level upper reflection mirror 21. Light emitted by the LED light source 3 in the lower row (that is, the LED light source 3 that is located in the lower row in the LED light source array) is incident into the lens 1 after being reflected first by the first level reflection mirror 20 and then by the second level lower reflection mirror 22.

Specifically, referring to FIG. 3, the first level reflection mirror 20 has a first level upper reflection surface 201 corresponding to the LED light source 3 in the upper row and a first level lower reflection surface 202 corresponding to the LED light source 3 in the lower row. The second level upper reflection mirror 21 has a second level upper reflection surface 211 corresponding to the first level upper reflection surface 201 of the first level reflection mirror 20. The second level lower reflection mirror 22 has a second level lower reflection surface 221 corresponding to the first level lower reflection surface 202 of the first level reflection mirror 20. The first level upper reflection surface 201, the first level lower reflection surface 202, the second level upper reflection surface 211, and the second level lower reflection surface 221 each has a high reflectivity. Light emitted by a single LED light source 3 located in the upper row is first incident into a first level upper reflection surface 201 of a corresponding first level reflection mirror 20, is incident into a second level upper reflection surface 211 of a corresponding second level upper reflection mirror 21 after being reflected by the first level upper reflection surface 201, and is incident into the lens 1 after being reflected by the second level upper reflection surface 211. Light emitted by a single LED light source 3 located in the lower row is first incident into a first level lower reflection surface 202 of the corresponding first level reflection mirror 20, is incident into a second level lower reflection surface 221 of the corresponding second level lower reflection mirror 22 after being reflected by the first level lower reflection surface 202, and is incident into the lens 1 after being reflected by the second level lower reflection surface 221. The light incident into the lens 1 forms an illuminating light pattern after being transmitted by the lens 1.

In the present embodiment, the reflection structure 2 comprises a frame body 23. A cavity is disposed inside the frame body 23, and two ends of the cavity facing the LED light source array and the lens 1 are provided with openings. All the first level reflection mirrors 20, the second level upper reflection mirrors 21, and the second level lower reflection mirrors 22 are disposed inside the cavity. Preferably, in the present embodiment, the first level reflection mirrors 20 in all reflection mirror sets form an integer member transversely extending along the LED light source array. The length of the integer member is not less than a transverse length of the LED light source array. All the second level upper reflection mirrors 21 are sequentially arranged above the integer member in a linear array, and are in one-to-one correspondence with the LED light sources 3 in the upper row; and all the second level lower reflection mirrors 22 are sequentially arranged below the integer member in a linear array, and are in one-to-one correspondence with the LED light sources 3 in the lower row.

In the vehicle lamp illuminating apparatus in the present embodiment, each LED light source 3 located in the upper row and the first level upper reflection surface 201 of the first level reflection mirror 20 and the second level upper reflection surface 211 of the second level upper reflection mirror 21 corresponding to the LED light source 3 located in the upper row form a reflection unit. Each LED light source 3 located in the lower row and the first level lower reflection surface 202 of the first level reflection mirror 20 and the second level lower reflection surface 221 of the second level lower reflection mirror 22 corresponding to the LED light source 3 located in the lower row also form a reflection unit. The LED light sources 3 distributed in an array and the reflection mirror sets form a reflection unit array. Light emitted by each LED light source 3 is incident into the lens 1 after being reflected by the reflection mirror set, and forms a flare after being transmitted by the lens 1. That is, the light emitted by a single reflection unit forms a flare after being transmitted by the lens 1. The flare may be used as a pixel spot of an integer illuminating light pattern formed after light emitted by the reflection unit array is transmitted by the lens 1, thus implementing pixelation of the illuminating light pattern. A flare formed after light emitted by each reflection unit is transmitted by the lens 1 can be individually controlled by individually controlling turning on, turning off and luminance of each LED light source 3. When all the LED light sources 3 are turned on, the light emitted by the reflection unit array forms a complete illuminating light pattern after being transmitted by the lens 1 (referring to FIG. 4); and when one or more LED light sources 3 are turned off or luminance thereof is reduced, a flare formed by the reflection unit corresponding to the LED light source 3 disappears or is darkened, so that an illuminating light pattern with a local loss is formed (referring to FIG. 5). In this way, the vehicle lamp illuminating apparatus in the present embodiment can adjust luminance of one or more local areas of an illuminating light pattern, thereby implementing various illuminating light patterns and meeting a self-adaptive requirement of a headlamp. Especially, when a vehicle comes from an opposite direction, an LED light source 3 of a reflection unit forming a flare in an area is turned off by determining the area corresponding to the coming vehicle in the illuminating light pattern. When necessary, luminance of an LED light source 3 of a neighboring reflection unit may further be reduced. Therefore, the illuminating light pattern can be prevented from dazzling a driver of a coming vehicle, and desirable illumination in other areas than the area in which the coming vehicle is located is ensured, thereby ensuring driving safety.

Preferably, in the present embodiment, the second level upper reflection mirror 21 and the second level lower reflection mirror 22 are in an encircling form, and an opening direction faces the lens 1.

Preferably, in the present embodiment, the first level upper reflection surface 201 and the first level lower reflection surface 202 of the first level reflection mirror 20 form a cone whose contraction opening faces a position between the two LED light sources 3 that are vertically opposite to each other.

Preferably, in the present embodiment, the first level upper reflection surface 201 and the first level lower reflection surface 202 of the first level reflection mirror 20 are all ellipsoidal surfaces. The ellipsoidal surface has a first focus and a second focus. The second level upper reflection surface 211 of the second level upper reflection mirror 21 and the second level lower reflection surface 221 of the second level lower reflection mirror 22 are all curved surface. Preferably, the second level upper reflection surface 211 of the second level upper reflection mirror 21 and the second level lower reflection surface 221 of the second level lower reflection mirror 22 are all parabolic-like surfaces. The LED light source 3 in the upper row is located at the first focus of the first level upper reflection surface 201 corresponding to the first level reflection mirror 20, and the second focus of the first level upper reflection surface 201 coincides with a focus of the second level upper reflection surface 211 corresponding to the second level upper reflection mirror 21. Likewise, the LED light source 3 in the lower row is located at the first focus of the first level lower reflection surface 202 corresponding to the first level reflection mirror 20, and the second focus of the first level lower reflection surface 202 coincides with a focus of the second level lower reflection surface 221 corresponding to the second level lower reflection mirror 22. Certainly, the first level upper reflection surface 201 and the first level lower reflection surface 202 of the first level reflection mirror 20 are not limited to ellipsoidal surfaces, and may each use a free-form curved surface or a plane.

Preferably, in the present embodiment, a first shielding member 51 is disposed between the LED light source 3 in the upper row and the second level upper reflection mirror 21. The first shielding member 51 is configured to prevent the light emitted by the LED light source 3 in the upper row from being directly incident into the second level upper reflection surface 211 of the second level upper reflection mirror 21, so that all light emitted by the LED light source 3 in the upper row is incident into the second level upper reflection surface 211 of the second level upper reflection mirror 21 after being first reflected by the first level upper reflection surface 201 of the first level reflection mirror 20. A second shielding member 52 is disposed between the LED light source 3 in the lower row and the second level lower reflection mirror 22. The second shielding member 52 is configured to prevent the light emitted by the LED light source 3 in the lower row from being directly incident into the second level lower reflection surface 221 of the second level lower reflection mirror 22, so that all light emitted by the LED light source 3 in the lower row is incident into the second level lower reflection surface 221 of the second level lower reflection mirror 22 after being first reflected by the first level lower reflection surface 202 of the first level reflection mirror 20. Further, a shielding member (not shown in the figure) may be disposed between two neighboring reflection units to prevent incident light of the reflection unit from affecting a neighboring or nearby reflection unit.

Preferably, in the present embodiment, the lens 1 may use a balsaming lens. The balsaming lens is made of two materials of different refractive indexes by using a multiple-color injection molding manufacturing process, and mainly functions for de-dispersion.

Based on the foregoing vehicle lamp illuminating apparatus, the present embodiment further provides a vehicle lamp assembly. The vehicle lamp assembly of the present embodiment comprises the foregoing vehicle lamp illuminating apparatus of the present embodiment.

Based on the foregoing vehicle lamp assembly, the present embodiment further provides a vehicle. The vehicle of the present embodiment comprises the foregoing vehicle lamp assembly of the present embodiment.

In conclusion, in the vehicle lamp illuminating apparatus, the vehicle lamp assembly comprising the vehicle lamp illuminating apparatus, and the vehicle comprising the vehicle lamp assembly of the present embodiment, the reflection structure 2 is disposed between the LED light source array and the lens 1, so that all light emitted by the LED light sources 3 can be incident into the lens 1 after being reflected for two levels by the reflection structure 2. A flare formed after light emitted by each reflection unit is transmitted by the lens 1 can be individually controlled by individually controlling turning on, turning off and luminance of each LED light source 3. Therefore, luminance of one or more local areas of an illuminating light pattern can be adjusted. In this way, various illuminating light patterns are implemented and a self-adaptive requirement of a headlamp is met. Especially, when a vehicle comes from an opposite direction, an LED light source 3 of a reflection unit forming a flare in an area is turned off by determining the area corresponding to the coming vehicle in the illuminating light pattern. When necessary, luminance of an LED light source 3 of a neighboring reflection unit may further be reduced. Therefore, the illuminating light pattern can be prevented from dazzling a driver of a coming vehicle, and desirable illumination in other areas than the area in which the coming vehicle is located is ensured, thereby ensuring driving safety.

The foregoing descriptions are merely preferred implementations consistent with the present invention. It should be noted that those skilled in the art may make several improvements or substitutions without departing from the principle consistent with the present invention and the improvements or substitutions shall fall within the protection scope consistent with the present invention.

What is claimed is:

1. A vehicle lamp illuminating apparatus, comprising a lens (1), a circuit board (4), a plurality of light emitting diode (LED) light sources (3) disposed on the circuit board (4) and distributed in an array, and a reflection structure (2) disposed between the plurality of LED light sources (3) and the lens (1), wherein the plurality of LED light sources (3) distributed in an array are transversely arranged in an upper row and a lower row, the reflection structure (2) comprises a plurality of reflection mirror sets each disposed in one-to-one correspondence with two LED light sources (3) that are vertically opposite to each other, the reflection mirror set comprises a first level reflection mirror (20) located between the two LED light sources (3) that are vertically opposite to each other, and a second level upper reflection mirror (21) and a second level lower reflection mirror (22) that are respectively disposed above and below the first level reflection mirror (20) at an interval in an opposite manner; and light emitted by the LED light source (3) in the upper row is incident into the lens (1) after being reflected first by the first level reflection mirror (20) and then by the second level upper reflection mirror (21), and light emitted by the LED light source (3) in the lower row is incident into the lens (1) after being reflected first by the first level reflection mirror (20) and then by the second level lower reflection mirror (22).

2. The vehicle lamp illuminating apparatus as in claim 1, wherein the second level upper reflection mirror (21) and the second level lower reflection mirror (22) are in an encircling form, and an opening direction faces the lens (1).

3. The vehicle lamp illuminating apparatus as in claim 1, wherein the first level reflection mirror (20) has a first level upper reflection surface (201) corresponding to the LED light source (3) in the upper row and a first level lower reflection surface (202) corresponding to the LED light source (3) in the lower row, and the first level upper reflection surface (201) and the first level lower reflection surface (202) form a cone whose contraction opening faces a position between the two LED light sources (3) that are vertically opposite to each other.

4. The vehicle lamp illuminating apparatus as in claim 1, wherein the first level reflection mirror (20) has a first level upper reflection surface (201) corresponding to the LED light source (3) in the upper row and a first level lower reflection surface (202) corresponding to the LED light source (3) in the lower row, and the first level upper reflection surface (201) and the first level lower reflection surface (202) both have ellipsoidal surfaces, free-form curved surfaces, or planes.

5. The vehicle lamp illuminating apparatus as in claim 1, wherein a first shielding member (51) configured to prevent the light emitted by the LED light source (3) in the upper row from being directly incident into the second level upper reflection mirror (21) is disposed between the LED light source (3) in the upper row and the second level upper reflection mirror (21); and a second shielding member (52) configured to prevent light emitted by the LED light source (3) in the lower row from being directly incident into the second level lower reflection mirror (22) is disposed between the LED light source (3) in the lower row and the second level lower reflection mirror (22).

6. The vehicle lamp illuminating apparatus as in claim 1, wherein the LED light source (3) is disposed on the circuit board (4), rotates around the transverse, wherein a maximum angle by which the LED light source (3) transversely rotates does not exceed 45°.

7. The vehicle lamp illuminating apparatus as in claim 1, wherein the lens (1) is a balsaming lens.

8. A vehicle lamp assembly, comprising the vehicle lamp illuminating apparatus as in claim 1.

9. A vehicle, comprising the vehicle lamp assembly as in claim 8.

* * * * *